United States Patent [19]

Oswell

[11] 4,295,617

[45] Oct. 20, 1981

[54] SELECTABLE DRAG BRAKES FOR ROCKET RANGE CONTROL

[75] Inventor: Herman R. Oswell, Huntsville, Ala.

[73] Assignee: The United States of America as represented by the Secretary of the Army, Washington, D.C.

[21] Appl. No.: 81,302

[22] Filed: Oct. 2, 1979

[51] Int. Cl.[3] ..... F42B 13/32

[52] U.S. Cl. ..... 244/3.29; 244/3.27

[58] Field of Search ..... 244/3.27, 3.29

[56] References Cited

U.S. PATENT DOCUMENTS

| | | | |
|---|---|---|---|
| 1,166,879 | 1/1916 | Alard | 244/3.29 |
| 1,879,840 | 9/1932 | Brandt | 244/3.29 |
| 3,063,375 | 11/1962 | Hawley et al. | 244/3.29 |
| 3,188,958 | 6/1965 | Burke et al. | 244/3.29 |
| 3,588,004 | 6/1971 | Suter | 244/3.29 |
| 3,598,345 | 6/1971 | Suter | 244/3.29 |
| 4,162,053 | 7/1979 | Bjornson | 244/3.27 |

*Primary Examiner*—Sal Cangialosi

*Attorney, Agent, or Firm*—Nathan Edelberg; Robert P. Gibson; Harold W. Hilton

[57] ABSTRACT

Selectable drag brakes disposed for activation for controlling the range of artillery rockets. The brakes are remotely actuated for extension in one of three drag brake zones (full, ½, zero).

3 Claims, 5 Drawing Figures

SELECTABLE DRAG BRAKES FOR ROCKET RANGE CONTROL

BACKGROUND OF THE INVENTION

One of the main drawbacks to conventional artillery rockets (such as Honest John) is the fact that their range can only be controlled by variation of the launch elevation angle. This results in a requirement to fire at very low elevation angles (5° or less) to achieve desired minimum range. Obviously, this is not possible in mountainous terrain. One technique used to overcome this limitation is thrust termination; however, this is quite expensive and totally unsuitable for low cost, free-flight rockets.

Drag brakes have been proposed at various times as a method of range control; however, as yet, no satisfactory solution has been proposed for the rapid, remote setting of drag brakes. The method proposed herein will allow the remote setting of drag brakes, and will provide 3 drag brakes zones (full, ½, and zero). Four drag brakes (operable in pairs) are mounted around the rocket nozzle and are interdigitated with the fins.

SUMMARY OF THE INVENTION

Drag brakes are disposed around the rocket nozzle and are normally carried in closed position. The brakes rotate about axes normal to the centerline of the rocket. A spring is used to provide the torque necessary to initiate drag brake opening, and the brakes are held in extended position by the combined effects of the spring torque and the aerodynamic forces. The drag brakes are allowed to open only if an electrical signal is received to actuate a squib or solenoid valve associated with each pair of drag brakes. If no signal is received the brakes will not be extended.

DESCRIPTION OF THE PREFERRED EMBODIMENT

Figure 1:
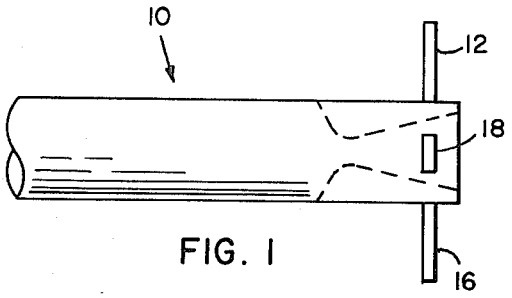
FIG. 1 is a partial elevational view of a rocket utilizing the drag brakes of the present invention. The rocket fins are not shown for clarity.
Figure 2:
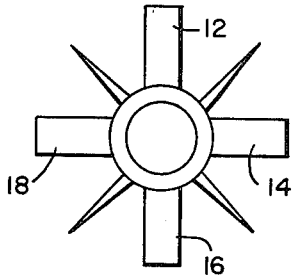
FIG. 2 is a rear view showing all four drag brakes in extended position.

As shown in FIGS. 1 and 2 a rocket 10 is provided with drag brakes 12, 14, 16 and 18. The drag brakes are normally carried in closed position and rotate about axes normal to the rocket centerline. A spring 20 provides the torque necessary to initiate drag brake extension. Spring 20 is secured to the aft end of the missile body 21 and to each of the drag brakes, as shown in FIGS. 2 and 3, for biasing the drag brakes outwardly.

Figure 3:
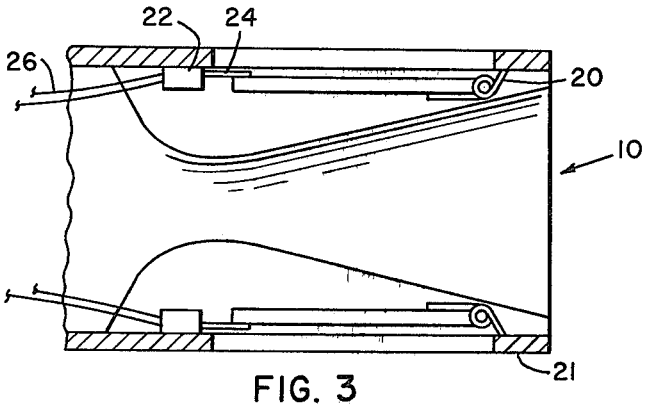
FIG. 3 is a partial elevational view illustrating the brakes in closed position and solenoid valves for actuating the brakes.

As shown in FIG. 3, a solenoid valve 22 is mounted in the rocket for displacing a pin 24 which retains the drag brakes in locked position. The valve is connected through leads 26 to a firing circuit. The leads are passed through an umbilical to the ignition circuit.

Figure 4:
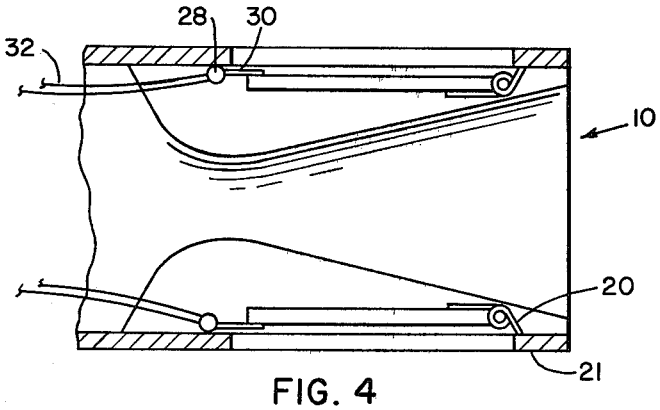
FIG. 4 is a view similar to FIG. 3 illustrating squibs for actuating the drag brakes.

As shown in FIG. 4, a squib 28 is mounted in the rocket for shearing a retaining pin 30 which retains the drag brakes in locked position. The squib is connected through leads 32 to a firing circuit. Leads 32 are passed through an umbilical to the ignition circuit.

In operation, the operator determines the range to the target and selectively actuates the desired drag brakes at launch. A key is depressed on a console (not shown) to complete the circuit to either the solenoid valves or the squibs and the spring extends the actuated pair of brakes.

Figure 5:
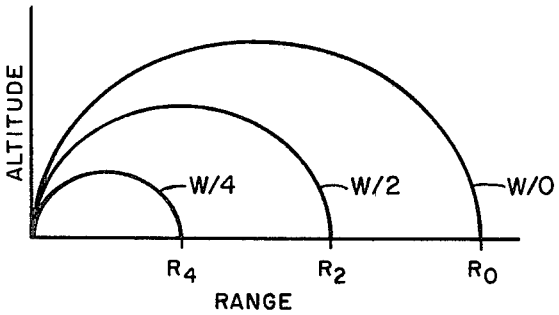
FIG. 5 is a view illustrating trajectories of the rocket in all three drag brake zones.

FIG. 5 illustrates the trajectories the rocket will take. With no brakes extended the trajectory is indicated at Ro. With two brakes extended the trajectory is indicated at R2, and with four brakes extended the trajectory is indicated at R4.

I claim:

1. Apparatus for controlling the range of a free-flight artillery rocket comprising:

(a) a plurality of drag brakes disposed around the periphery of the motor of said rocket;

(b) means for retaining said drag brakes in unextended position said means including a pin for engagement with each of said drag brakes for secured relation thereof;

(c) actuating means for selectively releasing predetermined pairs of said drag brakes; and, (d) means for releasing said drag brakes to an extended position responsive to energization of said actuating means said means for releasing said drag brakes to said extended position being a spring secured to one end of each said drag brake and said rocket.

2. Apparatus as in claim 1 wherein said actuating means is a solenoid valve in engagement with said pin, said valve being electrically connected to an energizing circuit.

3. Apparatus as in claim 1 wherein said actuating means is a squib in engagement with said pin, said squib being connected to an energizing circuit.

* * * * *